United States Patent [19]

Wardt et al.

[11] 4,179,262

[45] Dec. 18, 1979

[54] GAS-HEATING APPLIANCE

[76] Inventors: Volker Wardt, Muhlenweg 3a, Kleve Nutterden, Brd.; Heinz L. Gantevoort, Gruner Weg 4-6, Goch 5, Brd., Fed. Rep. of Germany

[21] Appl. No.: 840,232

[22] Filed: Oct. 7, 1977

[30] Foreign Application Priority Data

Oct. 7, 1976 [DE] Fed. Rep. of Germany ..... 2645263

[51] Int. Cl.[2] ..... F23D 13/40

[52] U.S. Cl. ..... 431/354; 239/499; 239/520

[58] Field of Search ..... 431/351–355; 239/499, 504, 520, 557

[56] References Cited

U.S. PATENT DOCUMENTS

| | | | |
|---|---|---|---|
| 2,533,143 | 12/1950 | Scharbau et al. | 431/353 |
| 2,858,729 | 11/1958 | Keyes | 431/354 |
| 3,002,553 | 10/1961 | Reed | 431/353 |
| 3,663,154 | 5/1972 | Locke | 431/353 |
| 3,779,694 | 12/1973 | Zagoroff | 431/352 |
| 3,816,062 | 6/1974 | Bouvier | 431/355 |
| 3,849,058 | 11/1974 | Pankow | 431/354 |

*Primary Examiner*—Carroll B. Dority, Jr.
*Attorney, Agent, or Firm*—Holman & Stern

[57] ABSTRACT

A gas heating appliance of the kind having a gripping handle through which fuel is supplied to a common feed pipe carrying a plurality of burners. Each burner has a separate nozzle branched off the feed pipe and a pair of opposing curved baffle walls are provided at each nozzle, the walls of each pair being separated by gaps at each nozzle, all the gaps being in mutual alignment. The appliance of the invention is particularly applicable to the heating of plastic foil type materials.

3 Claims, 3 Drawing Figures

GAS-HEATING APPLIANCE

Figure 1:
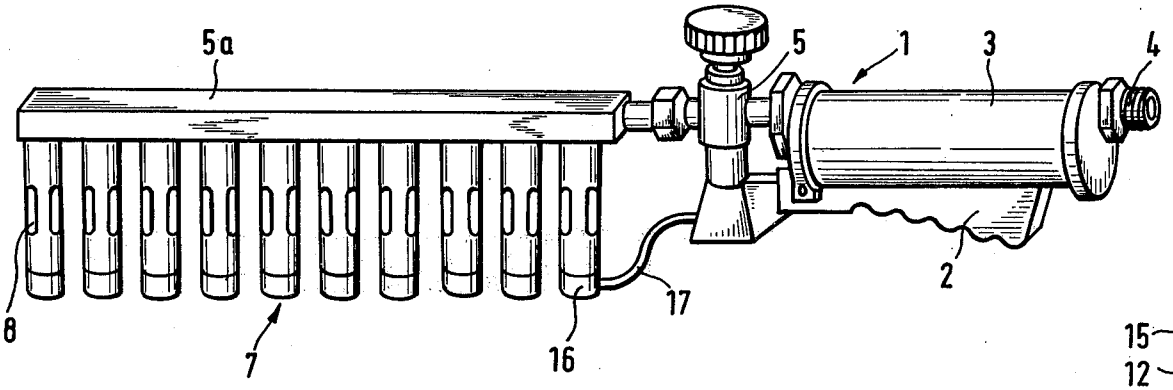

This invention concerns a gas heating appliance having a gripping and operating handle for applying heat treatment to plastics materials, and particularly for shrinking plastics foil, and being of the kind wherein combustion air is drawn into the appliance on the principle of a Bunsen burner and mixed with a fuel, especially with propane gas, in a mixer pipe at the end of which pipe a burner nozzle is provided to create a turbulent flow.

A gas heating appliance of this kind is described in German No. AS 22 54 891. In this prior arrangement the operating grip or handle is attached to the mixer pipe in the manner of a pistolgrip from which the intake section of the mixer pipe projects from one side and the outflow section of said pipe, surmounted by a combustion chamber which is followed by a second mixer pipe, projects from the other side. A comparatively bulky construction of this kind gives rise to the risk of the combustion air intake hole being accidentally obturated by a sleeve or other part of a garment of the person handling the appliance with the result that the flame would be extinguished. Moreover, this appliance includes a comparatively complex and expensive venturi jet for mixing the fuel gas with combustion air. The mixture is supplied to one or more combustion chambers which are operated in parallel with one another and situated equidistantly in a circle around a common centre point. For a uniform supply of mixture to the individual combustion chambers a complicated mixer pipe is required which, for a single common inlet hole, must be provided with a plurality of outlet ports corresponding in number to the number of combustion chambers provided in the appliance. As a result of these provisions, a heating gas jet is produced which is of generally slightly flattened, or where several combustion chambers are provided, radially symmetrical, cross-sectional form and this is subsequently mixed with air from the surrounding atmosphere in a second mixer pipe of slightly flattened, or ovalized, cross-sectional configuration. As a direct result of the provision of the said combustion chambers an appliance of this type, when applied to the shrinking of plastics foils, has a comparatively narrow effective range. This means that wide packaging foils must be treated strip-wise across their width by successive passes of the appliance along a corresponding number of bands, or strips, to cover the whole width thereof. A further difficulty arises from the fact that, owing to the type of combustion chamber provided in this appliance, effective heat application to the treated material varies across the effective range of the appliance and is maximal in the middle region thereof with a marked drop towards the marginal regions.

Against this prior art background the present invention aims to provide a gas heating appliance of the kind specified in which the above described disadvantages are minimised or avoided. Thus, the invention aims to provide an appliance which is less bulky and wherein the air intake holes are clear and unobstructed at all times, said appliance being capable of delivering a stream or jet or hot gas which is substantially wider than in existing appliances and presents a very evenly distributed temperature and flow-velocity across the whole of its width. Moreover, the invention aims to avoid complex geometrical shapes of the kind involved in existing arrangements for the supply of mixture to a plurality of combustion chambers and to provide an evenly distributed fuel supply to the heating gas stream across the whole width of the latter.

According to the invention a gas heating appliance comprises a gripping and operating handle, a gas feed pipe extending from the handle, means associated with the handle for supplying the feed pipe with a controlled flow of fuel and a plurality of gas burners disposed side by side along the length of the feed pipe, each burner comprising a gas jet communicating with the feed pipe, a mixer pipe having one end surrounding the gas jet, the mixer pipe defining lateral holes for the admission of combustion air from the atmosphere, a burner nozzle at the other end of the mixer pipe and a pair of part-cylindrical baffle walls forming an extension of the mixer pipe beyond the burner nozzle, the baffle walls defining a pair of spacer gaps therebetween with the spacer gaps of the respective burners being in mutual alignment.

Such an arrangement ensures, in the first place, that the same amount of fuel and air mixture is available for combustion at each of the burner nozzles. The distribution problem is simplified because an individual jet issues from the common feed pipe for each of the burners. Since the cross-section of the jets need only be very small whereas the cross-section of the feed pipe may be very large, it is possible to ensure reliably uniform and even distribution of mixture to the individual jets. The necessary combustion air is drawn or sucked in independently by the jet stream of gas delivered to each burner by its individually associated jet on the general principle of a Bunsen burner air-intake. However, the resulting total mixture volume, which is very large as compared with the fuel gas volume, is not split up or otherwise distributed, but in each case admitted in full to a single burner nozzle. For this reason it is possible to manage with only a single, very short mixer pipe, leaving the process of intimate and thorough mixing to be completed in the region of turbulence at the burner nozzle.

By virtue of these provisions a steady and uniform flame is obtained over the whole length of the burner-studded common feed pipe, the width of said flame depending solely on the length of the feed pipe and the number of burners individually fitted thereon. This means that it is possible to treat a given package in the course of a few manual passes with a very wide flame selected for this purpose. The hot gas jetstreams will mix with ambient atmospheric air without the aid of additionally provided, second mixer pipes, and they will impinge on the plastics foil at a sufficiently high temperature to shrink this material. Moreover, since all of the burners are situated in direct longitudinal prolongation of the gripping handle, it is no longer possible for any of the combustion air intake holes to become accidentally obturated by the operator.

Conveniently, the end of an ignition electrode in the form of a bent wire projects into a burner nozzle from the side of one of the spacer gaps between its deflector walls, for which the metal of the burner including the burner nozzle itself forms a suitable counter electrode, said electrode being connected to a voltage generator which is adapted to be activated by the depression of a ratchet lever or key on the gripping handle of the appliance. This voltage generator may be an electro-inductive or a piezoelectric device. A major advantage resides in that a shut-off valve may be fitted in the gripping handle so that the fuel gas will start to flow towards and into the burners only when the handle is pressed, and further handle depression will result in gas ignition which is initially confined to a single one of the burners. The spacer gaps between the baffle walls then permit this ignition to be instantaneously transmitted or extended to all of the other burners. The said spacer gaps also present the advantage that they allow the flame in the burner nozzle to suck in, and mix with, additional air from ambient atmosphere in order to produce a hot gas stream of optimum temperature for the designed purpose.

For preference, each burner nozzle comprises an annular disc with a central hole, situated between the end of the mixer pipe and the baffle walls. An annular disc of this type is perfectly sufficient to produce the required turbulence of gas flow in the region of the burner nozzle for the development of a stable flame in this region.

The mutually transmitted ignition of the individual burners as well as the suction capacity of the flames at the burner nozzles are further improved if the central opening or hole in the annular disc is surrounded by outwardly directed jets extending radially obliquely through the disc and whereof the individual cross-sections as well as the total cross-section is relatively small as compared with the central hole in the disc.

A further improvement in mutual ignition of adjacent burners and suction intake of additional atmospheric air is obtained if the diameter of the central hole in the annular disc is substantially the same as the width of the spacer gap between the baffle walls.

Finally, a flow-dynamically highly efficient system can be obtained with a minimum of production outlay by using a cylinder of constant diameter for the mixer pipe and the baffle walls.

Figure 3:
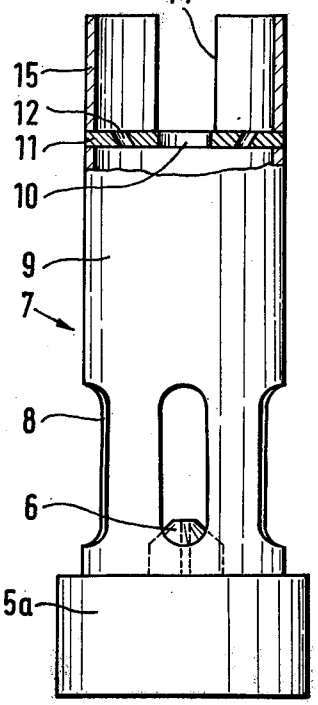
Figure 2:
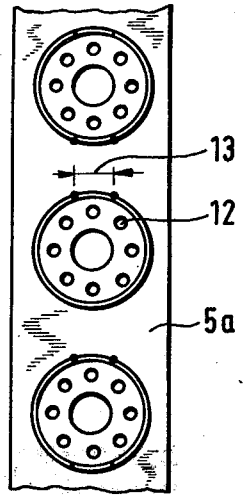

The invention will be hereinafter more specifically described with reference to the accompanying drawings illustrating a practical embodiment of the invention by way of example and wherein:

FIG. 1 is a general perspective side view of the gas heating appliance of the invention, FIG. 2 is an end view of the appliance of FIG. 1 showing some of the laterally adjacent burners, and FIG. 3 is a side elevation, partly in section, of one of the burners.

Referring to the drawings, the operating or gripping handle 1, which is fitted with a spring-loaded ratchet lever 2, will be seen on the right-hand side of FIG. 1. On its right-hand side the actual gripping part 3 of this handle 1 comprises a pipe connector 4 for connection to a fuel gas supply, whilst on the left hand or outflow side of part 3, there is provided a tap or shut-off valve 5 which can be pre-set to a specified rate of fuel gas flow. This pre-set valve 5 is opened to the preselected degree by means of the ratchet lever 2 so that the fuel gas may enter into the feed pipe 5*a*. From there it is conducted to the burners 7 through jets 6 of comparatively small individual cross-sectional dimensions which are most clearly shown in FIG. 3. The burners 7 have mixer pipes 9 formed with lateral holes 8 through which combustion air is sucked in from the surrounding atmosphere. The air and the fuel gas are then extensively mixed in the mixer pipe 9 and the mixture emerges substantially through the central hole 10 in the annular disc 11. A small portion of the mixture also flows out through the obliquely outwardly directed jets 12, which with hole 10 define a burner nozzle means.

The burners each have a pair of part-cylindrical baffle walls 15 extending beyond the discs 11 and defining spacer gaps 14 therebetween. With regard to their width the spacer gaps 14 correspond substantially to the diameter of the central hole 10, and FIG. 2 shows particularly well that these gaps 14 are mutually aligned, the start and end of each spacer gap being indicated by dots on the circumference of the burners which latter are of circular form, viewed in plan.

FIG. 1 also shows the end 16 of an ignition electrode, for which in the illustrated example a rigid wire 17 was used. This wire 17 extends into the burner through one of the spacer gaps and is connected to a device for generating an electric current which is located in the handle 3 and operated by the lever 2 in known manner.

We claim:

1. A gas heating applicance comprising a gripping and operating handle, a gas feed pipe extending from said handle, means associated with said handle for supplying said feed pipe with a controlled flow of fuel and a plurality of gas burners disposed side by side along the length of said feed pipe, each burner comprising a gas jet communicating with said feed pipe, a mixer pipe having one end surrounding said gas jet, said mixer pipe defining lateral holes for the admission of combustion air from the atmosphere, a burner nozzle means at the other end of said mixer pipe and a pair of part-cylindrical baffle walls forming an extension of said mixer pipe beyond said nozzle means, said baffle walls defining a pair of spacer gaps therebetween and wherein the spacer gaps of the respective burners are in mutual alignment, each burner nozzle means comprising an annular disc with a central hole, said central hole being surrounded by outwardly directed jets extending radially obliquely through the annular disc, and wherein the individual cross sectional area of the jets as well as the total cross sectional areas of the jets is small as compared with the central hole in the disc.

2. A gas heating appliance according to claim 1, wherein the diameter of the central hole in the annular disc is substantially equal to the width of the spacer gaps between the baffle walls.

3. A gas heating appliance according to claim 1, wherein the mixer pipe and the baffle walls define a cylinder of constant diameter.

* * * * *